United States Patent [19]

Butters

[11] 4,430,839

[45] Feb. 14, 1984

[54] SCAFFOLD FRAME

[75] Inventor: Gunter Butters, New South Wales, Australia

[73] Assignee: W. R. Carpenter and Co. Ltd., Manly Vale, Australia

[21] Appl. No.: 341,370

[22] Filed: Jan. 21, 1982

[30] Foreign Application Priority Data

Jan. 23, 1981 [AU] Australia ..... PE7350

[51] Int. Cl.[3] ..... E04G 1/14

[52] U.S. Cl. ..... 52/696; 52/638; 182/178; 182/179

[58] Field of Search ..... 182/178, 179; 52/637, 52/638, 641, 696

[56] References Cited

U.S. PATENT DOCUMENTS

| | | | |
|---|---|---|---|
| 1,568,099 | 1/1926 | Strauss | 52/641 |
| 3,011,586 | 12/1961 | Harvey | 52/637 |
| 3,084,761 | 4/1963 | Robertson | 182/178 |
| 3,656,580 | 4/1972 | Gostling | 182/178 |
| 4,263,984 | 4/1981 | Masuda | 182/179 |

FOREIGN PATENT DOCUMENTS

| | | | |
|---|---|---|---|
| 82723 | 2/1964 | France | 182/178 |
| 640256 | 5/1962 | Italy | 182/178 |
| 443632 | 2/1968 | Switzerland | 182/178 |
| 814221 | 6/1959 | United Kingdom | 182/179 |
| 901346 | 7/1962 | United Kingdom | 182/178 |

*Primary Examiner*—Reinaldo P. Machado
*Assistant Examiner*—Alvin Chin-Shue
*Attorney, Agent, or Firm*—Ladas & Parry

[57] ABSTRACT

A walk-through scaffolding having two first vertical frame components adapted to engage a hurdle top scaffolding frame, the first frame components each having a vertical tubular member to engage a corresponding spigot on the hurdle frame.

1 Claim, 3 Drawing Figures

FIG. 1
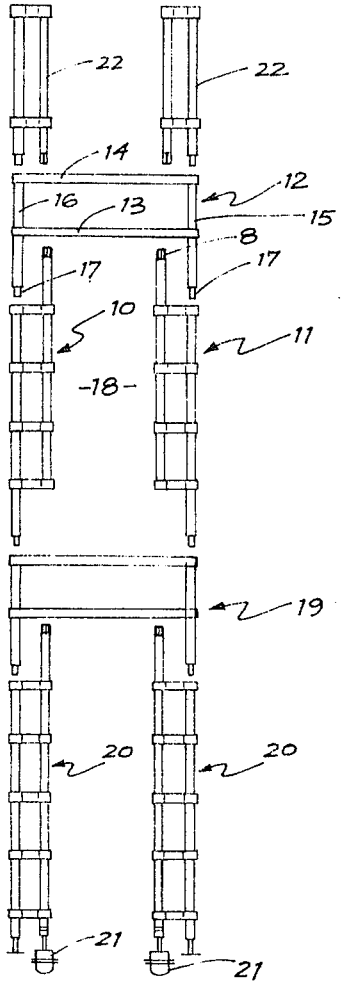
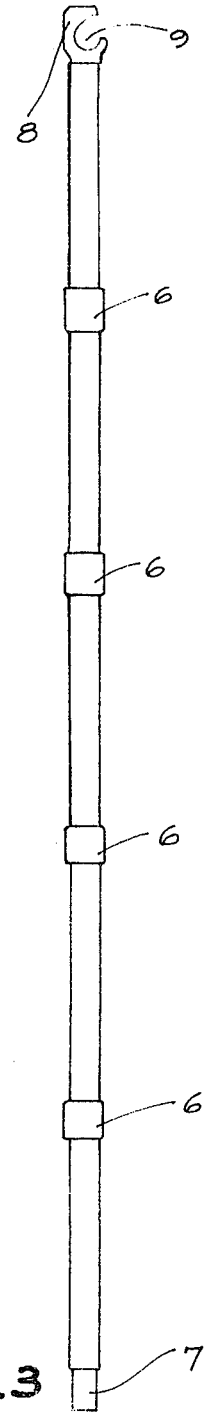
FIG.3
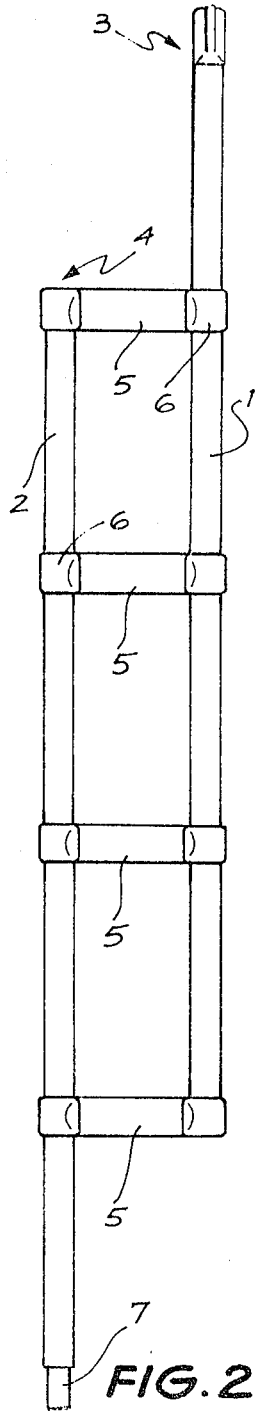
FIG. 2

SCAFFOLD FRAME

This invention relates to a scaffold frame and has been devised particularly though not solely as a scaffold frame fabricated from aluminium tubing.

In the past scaffold frames have conventionally been manufactured by welding mild steel tubing to a desired configuration and assembling the frame so formed. The frame components commonly include a "walk-through" frame which is basically an inverted U-shaped frame suitably reinforced to provide an archway component which enables an operator to walk through the frame along the length of the scaffolding framework.

It is now recognized that in many applications it is desirable to use scaffolding framework made from aluminium tubing which is a much lighter material and therefore easier and quicker to erect than the conventional framework fabricated from mild steel tubing. It has been difficult to fabricate a walk-through frame from aluminium tubing which is simple and cheap to manufacture and erect and which, at the same time, has the degree of rigidity and structural strength required of the walk-through frame.

It is therefore an object of the present invention to provide a scaffolding frame component and a scaffolding frame made from such component which will obviate or minimise the foregoing disadvantages in a simple yet effective manner or which will at least provide the public with a useful choice.

Accordingly in one aspect the invention may broadly be said to consist in a scaffolding frame component comprising a first upright tubular member, a second upright tubular member substantially the same length as said first tubular member, spaced therefrom in a staggered parallel relationship so that one end of said first member is higher than the corresponding end of said second member and a plurality of cross bars connecting and spacing said upright members.

Preferably said cross bars are orientated at right angles to said tubular members.

Preferably one said cross bar is located at the inwardly staggered end of each said upright member.

Preferably said upright tubular members and said cross bars are formed from aluminium tubing.

Preferably said upright tubular members and said cross bars are connected by suitable cast metal connecting members.

In a further aspect the invention may broadly be said to consist in a walk-through scaffolding frame comprising a hurdle-type frame having at least one cross member connecting two vertical members at either end thereof and two scaffolding frame components as described in any one or more of the preceding five paragraphs wherein the lower end of each vertical member is engaged with the upper end of the second upright tubular member of one respective said scaffolding frame component and the upper end of each first tubular member is engaged with said cross member.

Preferably said hurdle-type frame includes a second cross member located above said one cross member and interconnecting the upper ends of said two vertical members.

Notwithstanding any other forms that may fall within its scope, one preferred form of the invention will now be described with reference to the accompanying drawings, in which:

FIG. 1 is a diagrammatic exploded elevation of a scaffolding frame fabricated from components according to the invention;

FIG. 2 is a diagrammatic elevation to an enlarged scale of a scaffolding frame component according to the invention; and FIG. 3 is a side elevation of the component shown in FIG. 2.

In the preferred form of the invention a scaffolding frame component as shown in FIGS. 2 and 3 is constructed as follows:

The frame component comprises a first upright tubular member 1 and second upright tubular member 2 preferably formed from aluminium tubing but which may be made from any other desired material. The two tubes are spaced from one another in a staggered parallel relationship so that the upper end 3 of the first tube 1 is higher than the corresponding upper end 4 of the second tube 2. The two tubes are interconnected by a plurality of cross bars 5 which are preferably at right angles to the upright tubular members 1 and 2 and arranged so that there is one cross bar at the inwardly staggered end of each upright member. In the preferred form of the invention as shown in FIGS. 2 and 3 four equally spaced cross bars 5 are provided although it will be appreciated that other numbers and spacings of cross bars may be utilised. The cross bars are connected to the upright tubes 1 and 2 in any convenient or known manner and may, for example, be welded but in the preferred form of the invention, the connection is achieved by the use of a cast fitting 6.

The lower end of the second upright tubular member 2 is provided with a spigot 7 which may be engaged with the open upper end of another tubular scaffolding frame component as will be described further later and the upper end of the first upright tubular member 1 is provided with a fitting 8 incorporating a transverse notch 9 which may be engaged with a horizontal cross member as will be described further below.

In use two scaffolding frame components constructed as shown in FIGS. 2 and 3 are used in conjunction with a hurdle-type frame to form a walk-through frame as shown in FIG. 1. The two scaffolding frame components 10 and 11 are engaged with a hurdle-type frame 12 having cross members 13 and 14 connecting two upright vertical members 15 and 16. This frame is also preferably made from aluminium tubing joined by cast connecting members. The lower ends 17 of the hurdle frame vertical members are provided with spigots which are inserted into the open upper ends 4 of the second upright tubular members in the scaffolding frame components 10 and 11. The fittings 8 are then engaged with the cross member 13 so that the two scaffolding frame components 10 and 11 and the hurdle-type frame 14 form a continuous walk-through frame having an access space 18 for the operator.

A complete scaffolding framework may be built-up from similar components, for example, a further hurdle-type frame 19 and scaffolding frame components 20. The scaffolding frame components 20 are similar to the components 10 and 11 except that they are particularly adapted for use at the base of a scaffolding frame and are provided with mounting feet 21 adapted to be placed on the ground or alternatively engaged with a base frame. At the top of the completed scaffolding frame hand rail components 22 are provided fabricated from aluminium tube and cast connecting fittings in a similar manner to the other components and providing upright supports for a hande rail on the top of the scaffolding.

In this manner a scaffolding frame component is provided which enables a walk-through scaffolding frame to be simply and quickly constructed in a particularly rigid manner and which results in a light-weight frame. The component also has the advantage that the normal type of walk-through frame is broken down into smaller components for ease of storage, transportation and handling.

What I claim is:

1. A walk-through scafolding frame comprising, a first frame component having at least one horizontal cross member connecting to vertical members; two separate second frame components each having first and second upright tubular members which are fixed together by spaced cross bars so that the upper end of each said first member terminates above said second member, while the lower end of said second member terminates below said first member, wherein the lower ends of the vertical members of the first frame component and the upper ends of the second upright members are provided with co-operating male and female couplings enabling telescopic engagement thereof so that each vertical member is engaged with the upper end of a corresponding second upright tubular member, and the upper end of each first tubular member is provided with a coupling member of C-shaped configuration to engagingly encompass said cross member so as to prevent vertical relative movement therebetween.

* * * * *